United States Patent [19]

Nill

[11] Patent Number: 4,771,581

[45] Date of Patent: Sep. 20, 1988

[54] FLUID SUPPORT SYSTEM FOR BUILDING STRUCTURES

[76] Inventor: Raymond W. Nill, 6345 S. Humboldt Pl., Littleton, Colo. 80121

[21] Appl. No.: 906,154

[22] Filed: Sep. 11, 1986

[51] Int. Cl.[4] ..... E04B 1/34

[52] U.S. Cl. ..... 52/2; 52/167; 405/229

[58] Field of Search ..... 52/167, 198, 224, 264, 52/294, 293, 2 J; 405/229, 230

[56] References Cited

U.S. PATENT DOCUMENTS

| | | | |
|---|---|---|---|
| 2,410,338 | 10/1946 | Craine | 52/293 X |
| 3,232,015 | 2/1966 | Latham | 52/167 |
| 3,455,538 | 7/1969 | Vranian | 405/229 X |
| 4,126,976 | 11/1978 | Crowley | 52/264 X |
| 4,191,496 | 3/1980 | Becker | 405/229 |
| 4,266,379 | 5/1981 | Aguilar | 52/167 X |
| 4,517,778 | 5/1985 | Nicolai | 52/167 |

*Primary Examiner*—Carl D. Friedman
*Assistant Examiner*—Creighton Smith
*Attorney, Agent, or Firm*—Gary M. Polumbus

[57] ABSTRACT

A liquid support system for separating a building structure from its supporting foundation wall includes a trough-like member extending around the top surface of the foundation wall, an inverted U-shaped slide member slideably disposed over the trough member and a flexible but non-expandable liquid-filled conduit seated in the channel confined between the trough member and the slide member such that the weight of the building structure can be supported by the liquid-filled conduit. The conduit is divided into segments which can be separated into various sections whereby various sections can be maintained under higher liquid pressure than other segments to support the heavier portions of the building structure.

9 Claims, 3 Drawing Sheets

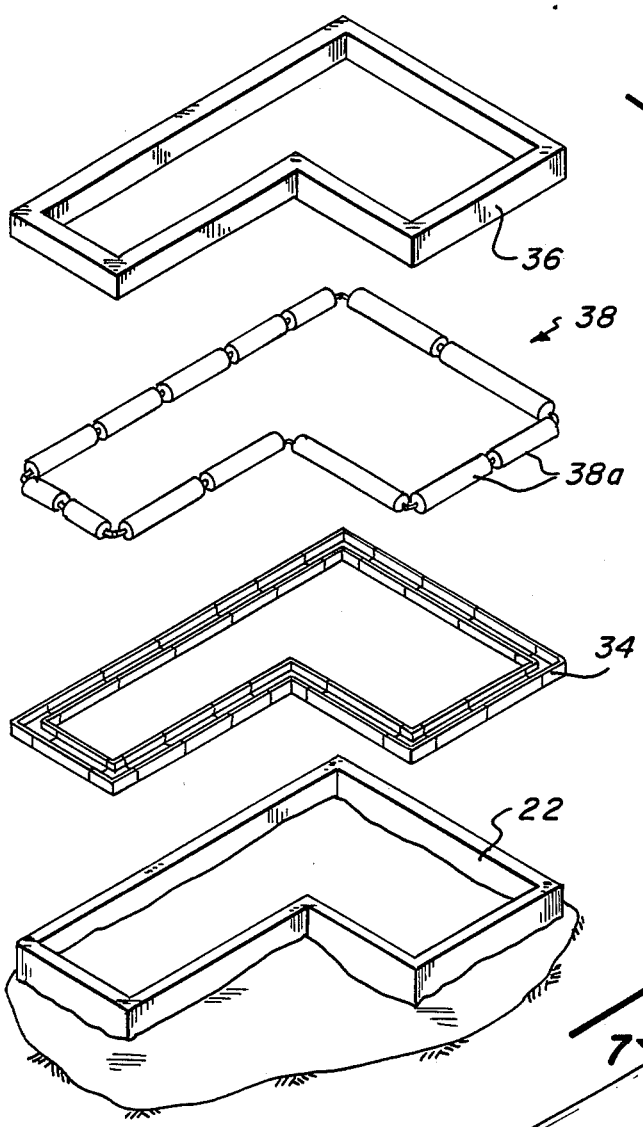
Fig_5
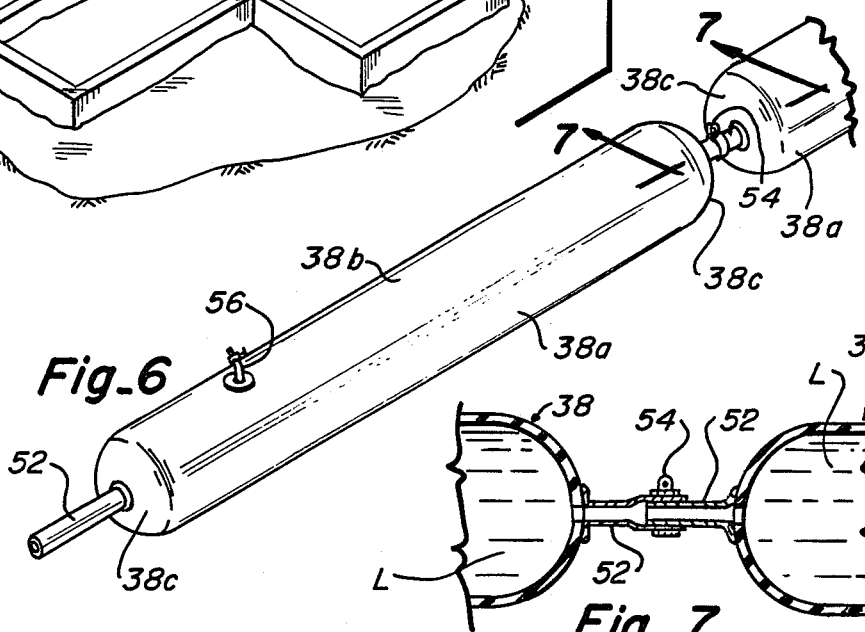
Fig_6
Fig_7

FLUID SUPPORT SYSTEM FOR BUILDING STRUCTURES

BACKGROUND OF THE INVENTION

1. Field Of The Invention

The present invention relates generally to support systems for building structures and, more particularly, to a support system for absorbing the movement of building foundations as might be caused by expanding soil or freezing and thawing of liquids in the soil.

2. Description Of The Prior Art

Expanding and contracting soils have presented problems in the support of building structures for many years. By way of example, many building structures are built on expanding clays, such as bentonite, which is known to absorb water or other liquids and expand in such a manner that it will lift foundation walls, thus causing the building structure which is supported by the foundation wall to crack. Similar problems are caused by the freezing and thawing of the water content of soils which causes the foundation walls to rise and fall depending upon the ambient temperature fluctuations.

Accordingly, the use of support systems for building structures which are capable of absorbing such soil movements have been considered and studied for many years. An example of such a system is disclosed in U.S. Pat. No. 4,191,496, issued to Becker, wherein large, airtight bags are filled with a gas under pressure so that the bags can support slabs of material on which the building structure is supported. The bags are designed so that gas can be directed into or removed from the bag as required to maintain a level floor condition.

Another system described in U.S. Pat. No. 4,266,379 issued to Aguilar is designed to eliminate friction between the foundation of a building structure and the surrounding soil by providing flexible, fluid-filled chambers mounted between the sides of foundation walls and the surrounding soil so that relative movements between the foundation wall and the soil can be absorbed by the chambers. This system is designed primarily to absorb seismic shocks, and therefore is not particularly concerned with expansion and contraction of soils as of the type which might cause a lifting or lowering of the foundation walls.

Another system for absorbing seismic shocks is disclosed in U.S. Pat. No. 3,232,015, issued to Latham, but Latham concerns itself more with absorbing shock than in absorbing the movement of expanding or contracting soil. The particular system disclosed in the Latham patent is for use in the support of large radar antennas or the like and basically utilizes the concept of supporting the antenna in a body of water to isolate the antenna from seismic shocks transmitted through the earth at the location where the antenna is mounted.

A different system for supporting a building structure so as to render the structure safe from earthquakes or the like is disclosed in U.S. Pat. No. 4,517,778 of Nicolai, but this system utilizes rollers and springs rather than fluid to support the building structure, and therefore operates on a different principle from the fluid support systems.

None of the prior art systems known to Applicant provides a liquid bed for separating a building structure from its foundation wall, and such a system, to Applicant's knowledge, is highly desirable, as it is the pressure which is applied directly to the foundation wall which causes poritons of the building structure to lift and crack. Accordingly, a system for absorbing vertical movements of foundation walls before the movement is transferred directly to the building structure would be highly desirable.

Accordingly, the primary object of the present invention is to provide a system for separating a foundation wall from its supported building structure in a manner such that vertical movement of the foundation wall caused by expanding or contracting soils can be absorbed to prevent transmittal of such movement into the building structure.

SUMMARY OF THE INVENTION

The present invention utilizes a liquid support system that is positioned between a building foundation and the building structure supported by the foundation so that if a vertical force is applied to the foundation by expanding or contracting soils, the force can be absorbed before it is transmitted into the building structure.

The system of the present invention utilizes an elongated conduit of a flexible but non-elastic material that carries an incompressible liquid under a predetermined pressure. The conduit is confined in a channel formed between two relatively slideable members so that vertical movement of a foundation wall at any particular location can be absorbed by displacing liquid in the conduit to a different location within the conduit, enabling the building structure to retain a horizontal orientation even though the supporting foundation wall has lost its horizontal orientation.

The support system of the present invention is uniquely designed from substantially identical segments of conduit which can be selectively interconnected to establish fluid communication between adjacent segments or to prevent such communication, thereby dividing a physically continuous conduit into any number of desired sections depending upon the weight distribution of the building structure to be supported.

Other aspects, features and details of the present invention can be more completely understood by reference to the following detailed description of a preferred embodiment, taken in conjunction with the drawings, and from the appended claims.

BRIEF DESCRIPTION OF THE DRAWINGS

FIG. 5 is an exploded fragmentary view of a continuous foundation wall having the support system of the present invention disposed thereon.

FIG. 6 is an enlarged fragmentary perspective veiw of a segment of conduit utilized in the support system of the present invention.

FIG. 7 is an enlarged section taken along line 7—7 of FIG. 6.

DESCRIPTION OF THE PREFERRED EMBODIMENT

Figure 1:
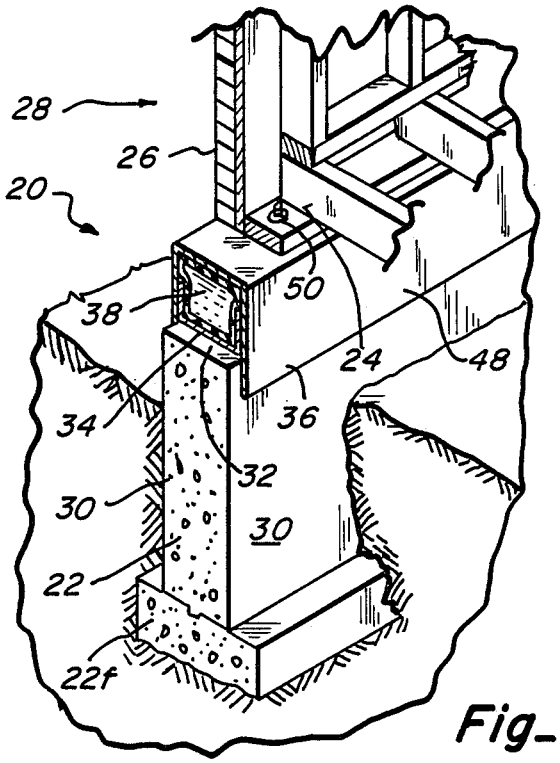
FIG. 1 is a fragmentary perspective section taken through a foundation wall with the supporting system of the present invention shown separating the foundation wall from a building structure.
Figure 2:
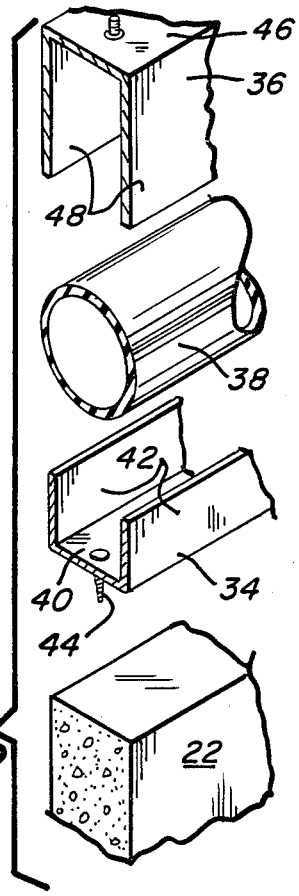
FIG. 2 is a fragmentary exploded perspective veiw of the component parts of the support system of the present invention and the foundation wall on which it is supported.

Referring first to FIGS. 1 and 2, the support system 20 of the present invention can be seen supported on a vertical foundation wall 22 between the foudation wall and the basic framework 24 and brick veneer 26 of a building structure 28.

The foundation wall 22 is illustrated as being supported on a horizontal footing 22*f*. The foundation wall has a pair of parallel vertical sides 30 and a top surface 32. The support system 20, as best seen in FIG. 2, includes a trough member 34, a slide support member 36 and a conduit 38 disposed between the trough member and slide support member.

The trough member 34 is preferably made of tin, steel or plastic material which will hold its desired configuration and has a U-shaped transverse cross-sectional configuration so that in it elongated form, it forms a trough in which the conduit 38 is seated. Accordingly, the trough member has a bottom wall 40 and two parallel and vertical side walls 42. The trough member extends continuously along the top surface 32 of the foundation wall 22 so as to form a complete top loop under the peripheral wall of the building structure 28. The trough member is preferably anchored to the foundation wall by concrete nails 44 or the like.

The slide support member 36 is also made of a material, such as tin, steel, plastic or the like, which will retain its configuration and has an inverted U-shaped transverse cross-sectional configuration so as to form an inverted trough when viewed in its elongated form. The slide support member has a top wall 46 and a pair of depending parallel and vertical side walls 48. The dimensions of the slide support are such that the interior separation of the vertical side walls 48 is substantially the same as the separation between the external surfaces of the said walls 42 of the trough member 34 whereby the slide support can be moved up and down in a sliding relationship with the trough member. As can be seen in FIG. 1, the side walls 48 of the slide support member are also tall enough so that they overlap the sides 30 of the foundation wall 22 as well as the side walls 42 of the trough member, so as to give additional stability to the system. The top wall 46 of the slide support preferably has a plurality of upstanding bolts 50 which are secured thereto or extended therethrough so that they can be attached to a stud member utilized as the base support for the framework 24 of the building structure.

The conduit 38 is formed from a plurality of substantially identical segments 38*a* of a plastic or rubber material which is flexible but non-expandable. A conduit section is best illustrated in FIG. 6 as having a generally cylindrical body 38*b*, in expanded configuration, with hemispherical opposite ends 38*c* having reduced diameter connection tubes 52 establishing means for interconnecting adjacent conduit segments. The conduit segments 38*a* are connected by inserting the connection tube 52 of one segment into the connection tube 52 of an adjacent segment and placing a conventional hose clamp 54 or the like therearound so that the interior of adjacent segments 38*a* are placed in fluid communication unless the clamp 54 is closed to seal the passageway through the reduced diameter tubes 52. By sealing the tubes, liquid communication between adjacent conduit segments can be prevented.

Each conduit segment 38a includes a valve stem 56 through which liquid can be injected into or removed from a segment as desired. This is accomplished with a conventional, manually-operated valve system 58, as illustrated in FIG. 11, which has a pressure gauge 60 thereon so that the pressure of the liquid in the segment 38*a* can be readily determined.

An incompressible liquid L, such as water, is injected into the conduit 38 under enough pressure to actually support the building structure 28. As the liquid L is injected into the conduit, the slide support member 36 will be elevated relative to the trough member 34, thereby placing the entire weight of the building structure on the liquid-filled conduit.

As will be appreciated, most building structures have their wieght distributed nonuniformly and, if a building structure were supported on a conduit which was in continuous liquid communication around the entire periphery of the building, the building would tend to set lower at locations where it was heavier than at locations where it was lighter. Accordingly, the support system 20 of the present invention is designed to provide independent conduit sections where the weight of the building is different so that fluid within a conduit section which underlies a heavier portion of the building structure can be sealed off from and maintained at a higher pressure than the liquid in the conduit which underlies lighter portions of the building structure. Accordingly, with the system of the present invention, the conduit 38 is continuous around the periphery of the foundation wall 22, but the fluid pressure within the conduit is selectively adjustable according to the particular weight distribution of the building structure. As mentioned previously, the continuous conduit is separated into any number of desired sections by clamping off the communication between adjacent segments thereby defining as many isolated sections of conduit as is desired for supporting the building structure.

Figure 3:
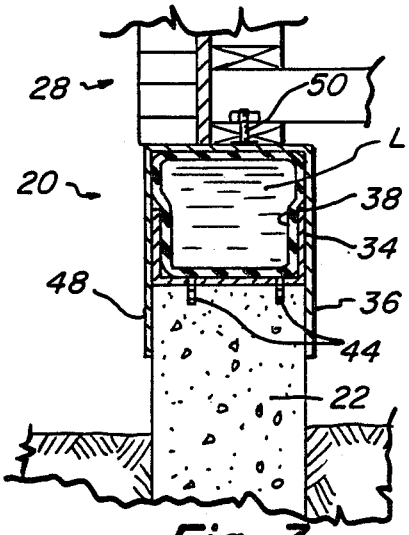
FIG. 3 is a fragmentary vertical section through a foundation wall, the support system, and a portion of a building structure in a normal orientation.
Figure 4:
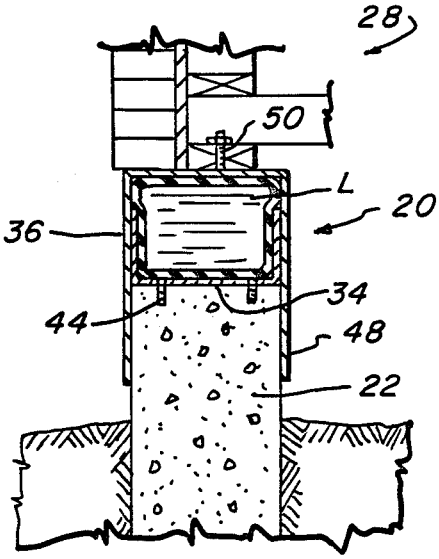
FIG. 4 is a fragmentary vertical section similar to FIG. 3 with the foundation wall having been moved upwardly with the movement being absorbed by the support system.
Figure 11:
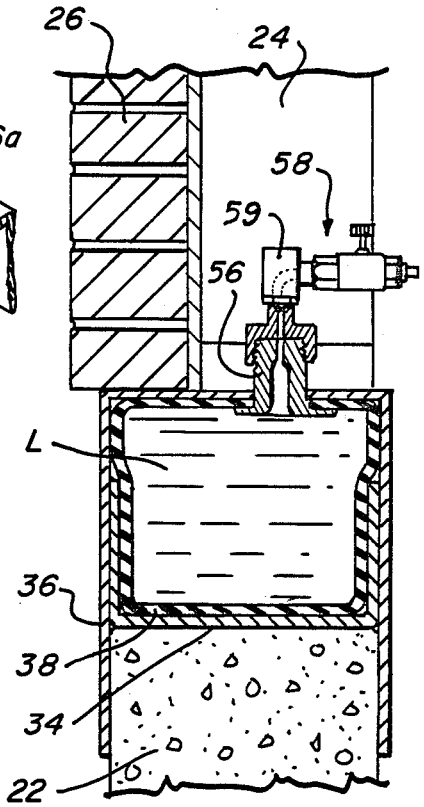
FIG. 11 is an enlarged fragmentary, vertical section through the foundation wall, support system and building structure with a liquid injection and removal system being connected to the conduit.

The valve stems 56 of each conduit segment 38*a* are accessible through the supporting framework 24 of the building structure, as is illustrated in FIG. 11, and once the structure is completed, the liquid can be injected into the various sections of the conduit through a valve communicating with that particular section of conduit. In this manner, the entire building structure can be elevated by the injection of pressurized liquid into the conduit so that the building is supported on a liquid bed. The conduits would not be completely filled with liquid, however, so that there would be room for expansion of the conduit upon a vertical movement of the foundation wall on which the conduit is supported. This is best illustrated in FIGS. 3 and 4, with FIG. 3 illustrating the orientation of the support system elements under normal conditions and FIG. 4 illustrating a vertical movement of the foundation wall 22 which might be caused by an expansion of an expandable clay upon which the foundation wall is seated. It can be seen that while the foundation wall 22 has moved upwardly, the building structure 28 has remained at its original elevation with the liquid within the conduit 38 having absorbed the vertical movement of the foundation wall by displacement of the liquid at the particular location where the wall was lifted to another location within that conduit section. In other words, the liquid within any conduit section maintains a uniform pressure distribution so that the spacing between the foundation wall 22 and the building structure 28 may vary along the length of a conduit section but the building structure will remain at a predetermined elevation.

Figure 9:
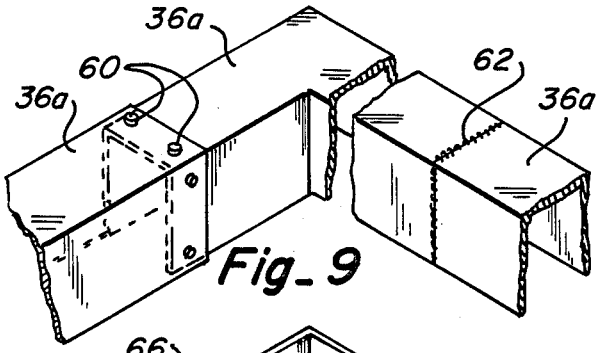
FIG. 9 is a fragmentary perspective view of the slide support member of the support system of the present invention with parts removed for clarity.
Figure 10:
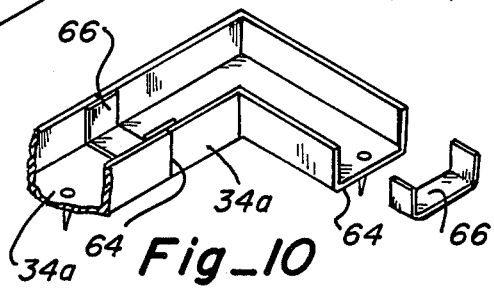
FIG. 10 is a fragmentary perspective view of a portion of the trough member of the support system of the present invention.

The slide support member 36 is made of a plurality of contiguous segments 36*a* which are joined together either by bolts 60 or by welding 62, as is illustrated in FIG. 9 for a reason to be explained later. The trough member 34, or the other hand, is preferably made of a plurality of disconnected segments 34*a* which can move vertically relative to each other. To prevent a rupturing of the conduit 38, however, the line of demarcation 64 between adjacent trough member segments 34*a* is covered by a saddle member 66 which overlies the line of demarcation but fits within the trough so as to separate the conduit 38 from the line of demarcation.

Figure 8:
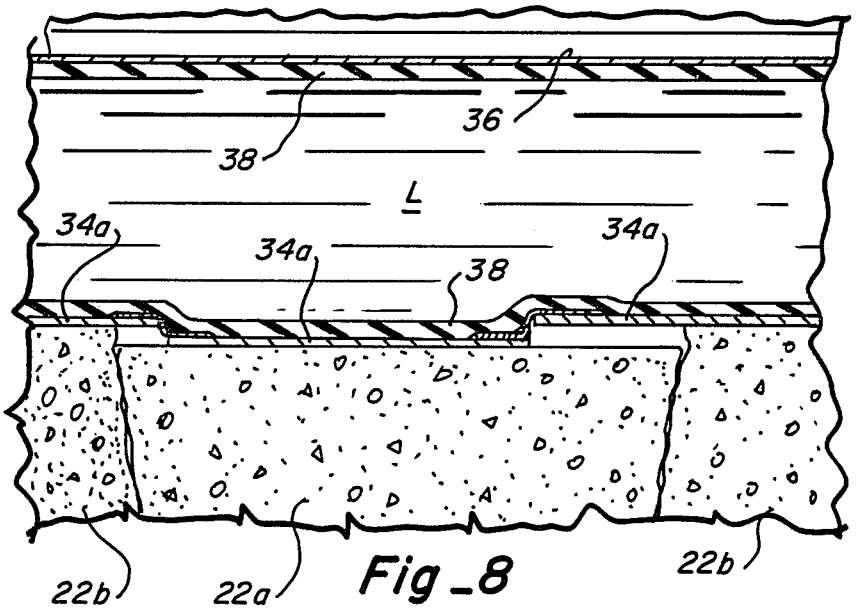
FIG. 8 is a fragmentary vertical section taken longitudinally of a foundation wall, the support system and building structure with a portion of the foundation wall having moved downwardly.

This particular formation of the trough member 34 and the slide support member 36 permits and facilitates vertical movement of the foundation wall 22 at isolated locations without affecting vertical movement of the building structure 28 as is illustrated in FIG. 8. As can be seen in FIG. 8, a portion of the foundation wall 22*a* has moved downwardly relative to the adjacent portions of the foundation wall 22*b* permitting a segment 34*a* of the trough member 34 to move downwardly with the foundation wall on which it is supported. As will also be appreciated, the flexible conduit 38 is allowed to follow the downward movement of the trough segment 34*a* and foundation wall 22*a*, but due to the uniform pressure distribution of the liquid within the conduit, the building structure, which is supported on the slide support member 36, does not move. The continuous integrated nature of the slide member assists in maintaining a uniform elevation of the building structure.

The continuous nature of the slide support member 36, the discontinuous nature of the trough member 34, and the segmented conduit 38 are all illustrated in FIG. 5 extending around a continuous foundation wall 22. As can be appreciated and as was mentioned previously, it can be seen that if a portion of the building structure 28 overlying one portion of the foundation wall was known to be heavier than other portions of the building structure, the segment of the conduit overlying that particular portion of the foundation wall can be sectioned off so as to retain liquid under a higher pressure. The particular sectioning of the conduit segments, of course, needs to be determined, based on building plans, from which the weight distribution of the building structure can be determined.

Although the present invention has been described with a certain degree of particularity, it is understood that the present disclosure has been made by way of example, and changes in detail or structure may be made without departing from the spirit of the invention, as defined in the appended claims.

I claim:

1. A system for supporting a building structure on a foundation wall which may be supported on expanding soils, wherein the wall is oriented vertically and has a top surface and parallel side surfaces comprising in combination, an enclosed flexible conduit disposed on said top surface and having an incompressible liquid therein, said conduit having a plurality of distinct serially interconnected segments and means between at least two of said segments for selectively interrupting the continuity of the incompressible liquid between said two segments, and a slide support overlying and being supported by said flexible conduit for vertical sliding movement relative to the wall, including means thereon for being secured to said building structure.

2. The system of claim 1 further including trough means secured to and extending along said top surface of the wall, and wherein said conduit is disposed in the trough means and the slide support overlies the trough means for vertical sliding movement relative thereto.

3. The system of claim 2 wherein the trough means and slide support cooperate in forming an enclosed channel along the top of the wall in which the conduit is confined.

4. The system of claim 1 wherein at least some of the segments include valve means for selectively injecting and removing liquid from the segment.

5. The system of claim 2 wherein said trough means includes a plurality of adjacent disconnected component parts of substantially identical cross-sectional configuration.

6. The system of claim 7 wherein said trough means is of substantially U-shaped cross section.

7. The system of claim 8 wherein said slide support is of substantially inverted U-shaped cross section.

8. The system of claim 7 wherein the slide support is slightly wider than said trough means and said wall so as to slideably fit along the outside of both the trough means and the wall.

9. The system of claim 2 wherein said means on the slide support for securing the slide support to the building structure includes a plurality of stud bolts.

* * * * *